US007067732B1

(12) United States Patent
Kuklinski

(10) Patent No.: US 7,067,732 B1
(45) Date of Patent: Jun. 27, 2006

(54) APPARATUS FOR UTILIZING WASTE HEAT FROM WEAPON PROPULSION SYSTEM TO PRODUCE VAPOR EXPLOSION

(75) Inventor: Robert Kuklinski, Portsmouth, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 63 days.

(21) Appl. No.: 10/901,312

(22) Filed: Jul. 22, 2004

(51) Int. Cl.
*F42B 15/10* (2006.01)

(52) U.S. Cl. ..... 114/20.1; 102/374

(58) Field of Classification Search ..... 114/20.1, 114/20.2, 22; 102/374, 375, 376, 377, 378, 102/379, 380, 381
See application file for complete search history.

(56) References Cited

U.S. PATENT DOCUMENTS 4,291,533 A * 9/1981 Dugger et al. ..... 60/240

* cited by examiner

*Primary Examiner*—Michael J. Carone
*Assistant Examiner*—Gabriel Klein
(74) *Attorney, Agent, or Firm*—James M. Kasischke; Jean-Paul A. Nasser; Michael P. Stanley

(57) ABSTRACT

The apparatus of the present invention uses waste heat generated by a weapon propulsion system to melt and ultimately superheat metal. Upon termination of the weapon mission, the apparatus explodes thereby causing molten and superheated metal to be instantly introduced to the liquid medium through which the weapon travels. The reaction of the molten and superheated metal with the liquid medium produces a vapor explosion that significantly enhances the effectiveness and lethality of the weapon.

7 Claims, 3 Drawing Sheets

PRIOR ART

APPARATUS FOR UTILIZING WASTE HEAT FROM WEAPON PROPULSION SYSTEM TO PRODUCE VAPOR EXPLOSION

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

1. Field of the Invention

The present invention generally relates to an apparatus that uses waste heat generated by a weapon propulsion system to produce a vapor explosion.

2. Description of the Related Art

Prior art rocket powered torpedoes are generally configured as shown in FIG. 1. Torpedo 10 travels through ambient fluid (e.g. ocean water) 12 in the direction indicated by arrow 14. Rocket casing 16 houses a rocket (not shown) and is in direct contact with ambient fluid 12 at the aft of torpedo 10. Thrust is produced by expelling gas through nozzle 18. The rocket produces waste heat that is dissipated by forced convection over the rocket casing 16 and the discharge of the exhaust into the ambient fluid 12. The remaining portion of torpedo 10 is constructed in sections and has a homing array (not shown) located in nose section 20, electronics section 22, warhead section 24 and exercise section 26. These sections are typically separated by bulkheads 28, 30, 32 and 34. Torpedo 10 also has an outer shell 30 which does not extend over rocket casing 16 in order to facilitate heat transfer of heat generated by the rocket to ambient fluid 12. In other configurations, a heat shield (not shown) is added to bulkhead 34 in order to prevent overheating of the forward sections of torpedo 10. Warhead section 24 contains high explosives that are detonated at the end of the torpedo's run (i.e. mission termination) in order to produce an explosion of which the most destructive effects are a shock wave and a vapor bubble. The amount of waste heat generated by the rocket is a considerable portion of the total energy contained in the rocket fuel. What is needed is an apparatus and method for utilizing the waste heat generated by the weapon's propulsion system to enhance the lethality of the weapon.

The prior art discloses several weapon propulsion systems and devices in Jenkins, U.S. Pat. No. 4,406,863; Short, U.S. Pat. No. 4,680,934; Hartman et al., U.S. Pat. No. 5,070,786; Duva, U.S. Pat. No. 5,253,473; Buzzett et al., U.S. Pat. No. 5,728,968; Woodall et al., U.S. Pat. No. 6,308,607; and Longardner, U.S. Pat. No. 6,400,896. However, such prior art systems do not utilize waste heat generated by the weapon propulsion system to enhance the lethality of the weapon.

SUMMARY OF THE INVENTION

It is therefore an object of the present invention to provide an apparatus can be integrated into a weapon and which significantly enhances the lethality of the weapon.

It is another object of the present invention to provide an apparatus that is integrated into a weapon and utilizes the heat from the weapon's propulsion system to produce a secondary explosion upon termination of the weapon's mission.

Other objects and advantages of the present invention will be apparent from the ensuing description.

Thus, the present invention is directed to an apparatus for utilizing waste heat from a weapon's propulsion system to increase the lethality of the weapon. Specifically, the present invention stores waste heat and coverts such waste heat into kinetic energy at the termination of the weapon's travel. The apparatus of the present invention effects storage of heat instead of exchanging the heat with ambient fluid as is done with prior art weapon propulsion systems. The stored heat is then used to melt and ultimately superheat metal. The detonation of the weapon warhead will scatter the molten metal in the presence of ambient fluid thereby resulting in a secondary vapor explosion. The secondary vapor explosion enhances the effectiveness and lethality of the weapon.

In one aspect, the present invention is directed to an apparatus for utilizing the waste heat energy of a weapon propulsion system to produce a vapor explosion. The apparatus comprises a metal structure having a body portion fabricated from a first metal having a first predetermined melting temperature, and a plurality of layers fabricated from a second metal embedded within the body portion and spaced apart from each other. The second metal has a second predetermined melting temperature that is less than the first predetermined melting temperature such that the second metal melts and attains superheat before the first metal. The body portion has a space sized to receive a propulsion device such that the body portion envelopes a substantial portion of the propulsion device. The space in the body portion has an opening from which an exhaust nozzle of the propulsion device can extend. The apparatus further includes an explosive device embedded in the body portion, and an electrical link connected to the explosive device to detonate the explosive device. The electrical link extends from the body portion.

BRIEF DESCRIPTION OF THE DRAWINGS

The foregoing features of the present invention will become more readily apparent and may be understood by referring to the following detailed description of an illustrative embodiment of the present invention, taken in conjunction with the accompanying drawings, in which.

DESCRIPTION OF THE PREFERRED EMBODIMENTS

Figure 1:
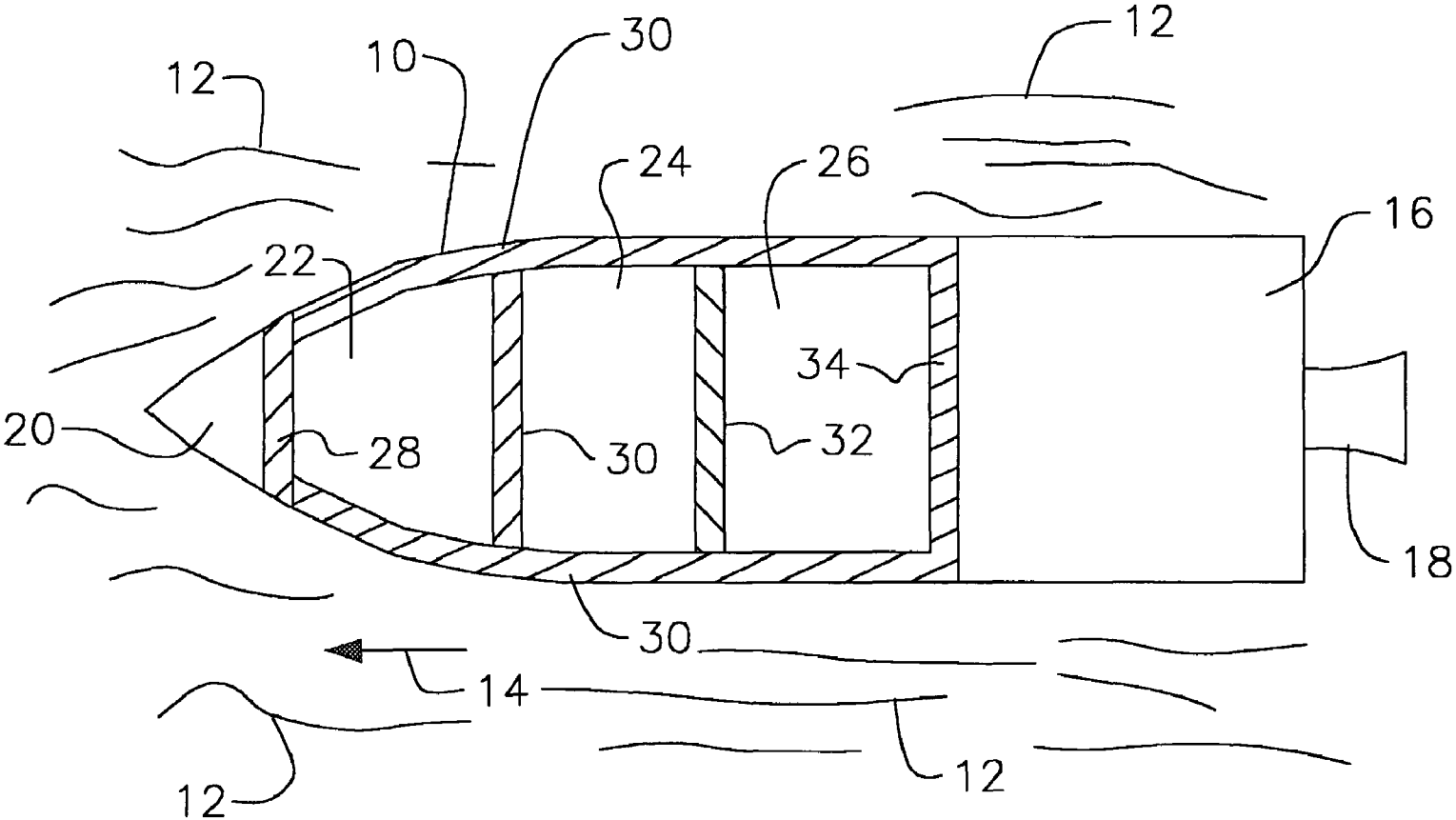
FIG. 1 is a side-elevational view, partially in cross-section, of a prior art torpedo.
Figure 2:
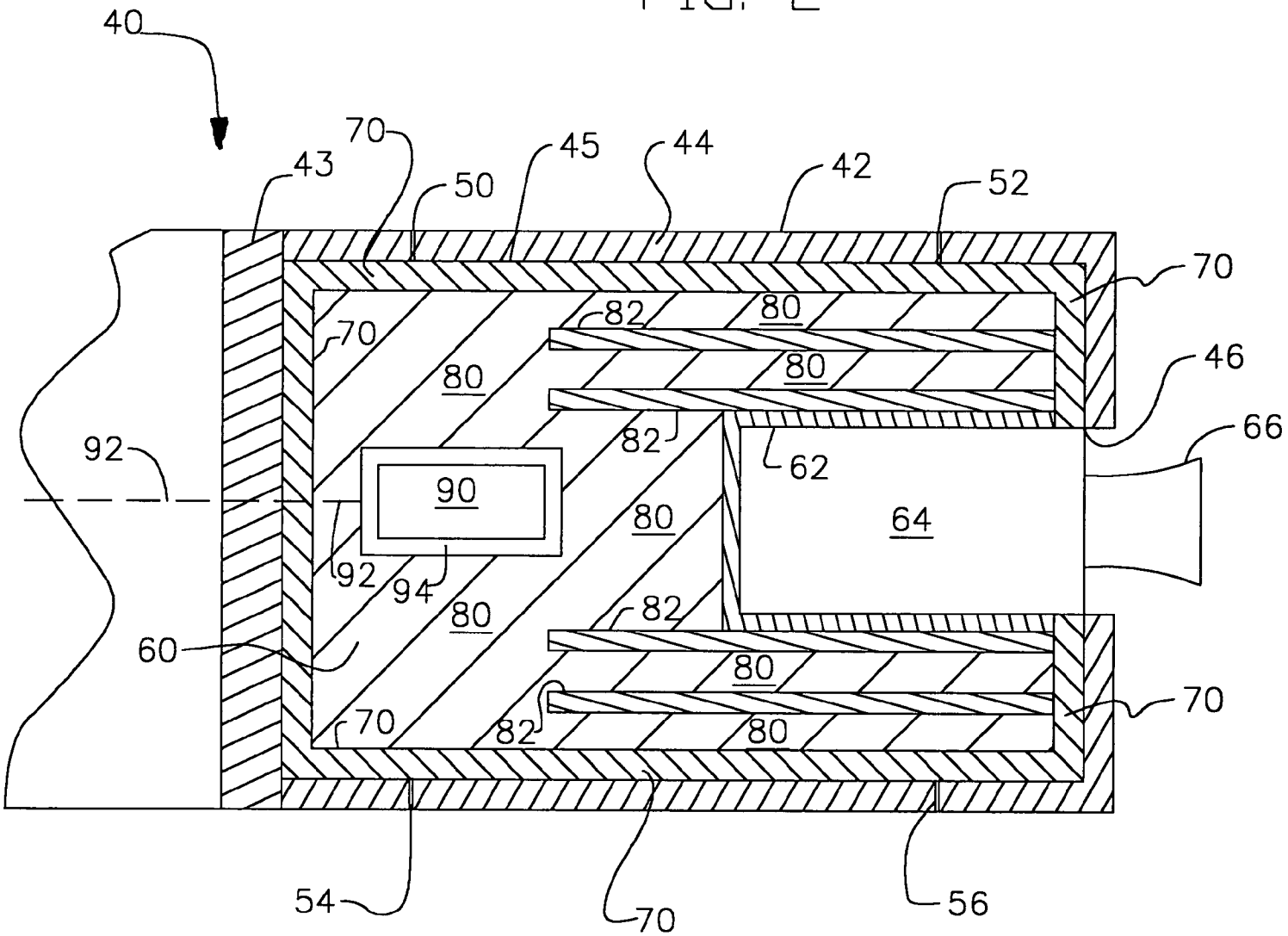
FIG. 2 is a cross-sectional view of the apparatus of the present invention.

Referring to FIG. 2, there is shown a partial view of a weapon 40 that utilizes apparatus 42 of the present invention. Weapon 40 can be a torpedo or similar weapon that travels through a liquid medium such as ocean water. Weapon 40 has bulkhead 43 that separates apparatus 42 from the other sections of the weapon. Apparatus 42 comprises outer shell 44 that cooperates with bulkhead 43 to form a chamber or compartment 45. Chamber 45 has a port 46 through which a propulsion exhaust device, such as a rocket nozzle 66, can extend. This feature is further described in the ensuing description. Outer shell 44 has seams 50, 52, 54 and 56 that will easily rupture when exposed to an internal explosion. Apparatus 42 comprises metal structure 60 that envelopes a substantial portion of a propulsion device of weapon 40. Metal structure 60 is described in detail in the ensuing description. The propulsion device includes rocket casing 62 and rocket 64 which is housed within rocket casing 62. Rocket 64 includes nozzle 66. In order to enhance the effectiveness and efficiency of apparatus 42, rocket casing 62 is preferably fabricated from a metal that has an extremely high melting point and good thermal conductivity to maximize radiation of waste heat therefrom. Suitable metals for fabricating rocket casing 62 include titanium; however, other suitable metals having the desired melting temperature and thermal conductivity can be used as well. Although weapon 40 is described as utilizing a rocket-type propulsion system, it is to be understood that apparatus 42 can be used with other types of weapon propulsion systems.

Referring to FIG. 2, in accordance with the invention, apparatus 42 further includes heat shield 70 that is positioned between metal structure 60 and outer shell 44. Heat shield 70 extends over aft bulkhead 43. Heat shield 70 may be fabricated form a variety of ceramic and evacuated layers. Heat shield 70 holds the waste heat generated from rocket 64 within compartment 45. Thus, heat shield 70 effects an increase in temperature in compartment 45 which enhances the effectiveness and efficiency of apparatus 42 as will be explained in the ensuing description.

Referring to FIG. 2, metal structure 60 comprises body portion 80 that is fabricated from a first metal that does not react with water (i.e. non-reactive), and a plurality of layers 82 formed of a second metal that does react with water (i.e. reactive). This two metal structure 60 gives some benefit during a short weapon run while maintaing structural integrity. After a longer run more of the body portion 80 will become molten. Layers 82 are embedded in body portion 80 and are spaced apart. In one embodiment, layers 82 are generally parallel to one another or concentric. Body portion 80 is configured to envelope rocket casing 62. In a preferred embodiment, some of layers 82 are embedded in body portion 80 in such a manner these layers 82 contact rocket casing 62. Metal structure 60 can be configured to have any type of shape, square, circular, etc. In a preferred embodiment, metal structure 60 occupies substantially all the available space within the confines of heat shield 70. Layers 82 can be arranged and positioned within body portion 80 in any one of a variety of geometrical arrangements. In one embodiment, layers 82 are arranged so as to generally form a matrix. The number of layers 82 can be varied depending upon the particular application and the desired magnitude of the vapor explosion. As shown in FIG. 2, metal structure 60 has explosive device 90 embedded therein. Electrical link 92 is connected to explosive device 90. Electrical link 92 can be a wire or cable that is capable of carrying electrical voltage signals. Electrical link 92 extends from metal structure 60, heat shield 70 and bulkhead 43 through appropriate sized bores, channels or openings (not shown). Electrical link 92 is electrically connected to weapon control module 100 (see FIG. 3). Upon mission termination, weapon control module 100 emits an electrical signal that detonates explosive device 90. In a preferred embodiment, heat shield 94 is positioned between explosive device 90 and metal structure 60 in order to thermally isolate explosive device 90.

Referring to FIG. 2, in accordance with the invention, the melting temperatures of the metals forming body portion 80 and layers 82 are significantly less than the melting temperature of the metal used to fabricate rocket casing 62. In accordance with the invention, the melting temperature of the metal forming body portion 80 is greater than the metal temperature of the metal that forms each of layers 82. Thus, the metal forming layers 82 will melt and reach superheat before the metal forming body portion 80. Suitable metals for layers 82 include lithium, magnesium, sodium, potassium, and lead. Such suitable metals include metals that will physically react with water by causing flash boiling, and metals that will cause an explosive chemical reaction upon contact with water; however, other suitable metals can be used as well. Suitable non-reactive metals for body portion 80 include aluminum and steel alloys. However, other suitable non-reactive metals can be used as well. At ambient temperature and at weapon launch, the metals used to form body portion 80 and layers 82 are in the solid state.

Referring to FIG. 2, the manner in which apparatus 42 is kept inert depends upon the type of metals used to fabricate body portion 80 and layers 82. For example, if the metal used to form body portion 80 is aluminum and the metal used to form layers 82 is magnesium, then apparatus 42 can be kept inert if apparatus 42 is kept cool. In another example, if the metal used to form body portion 80 is aluminum and the metal used to form layers 82 is lithium, then apparatus 42 can be kept inert if apparatus 42 is kept dry.

Figure 3:
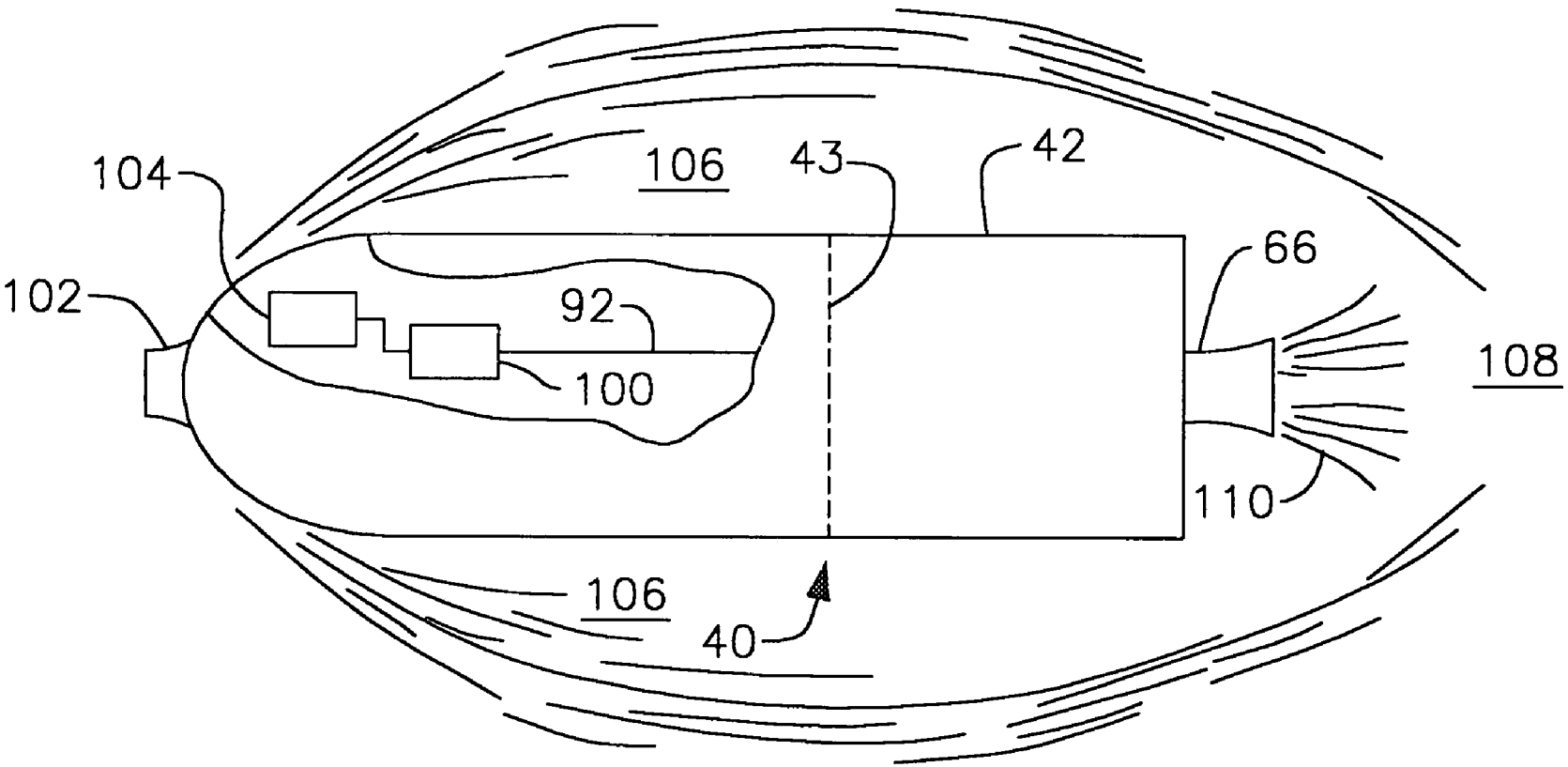
FIG. 3 is a side-elevational view of a weapon containing therein the apparatus of the present invention, the view showing an outer portion of the weapon being cut away to facilitate viewing of a ventilation system and weapon control module inside the weapon.

Referring to FIGS. 2 and 3, during operation of weapon 40, rocket 64 is fired to provide weapon thrust. Weapon 40 typically includes weapon control module 100, deployable cavitator 102, and ventilation system 104. Weapon control module 100 outputs an electrical signal over electrical link 92 to detonate explosive charge 90 upon termination of the mission. The configuration of weapon 40, as shown in FIG. 3, allows weapon 40 to operate in ventilated cavity 106. Ventilated cavity 106 has a cavity closure-point 108 that is located downstream of exhaust plume 110. As weapon 40 travels though a liquid medium (e.g. ocean water), the waste heat generated by rocket 64 and transferred by rocket casing 62 causes the temperature of metal structure 60 to increase. Heat shield 70 facilitates increase of the temperature of metal structure 60. Operation of weapon 40 in ventilated cavity 106 facilitates further increase in temperature of metal structure 60. As a result, the temperature of the metals forming body portion 80 and layers 82 quickly increase and approach superheat as the weapon mission time (e.g. torpedo run-time) increases. Since the melting temperature of the metal forming layers 82 is less than the metal forming body portion 80, layers 82 melt first and become a superheated liquid or molten metal. This superheated liquid or molten metal is extremely volatile. For example, if the metal forming body portion 80 is aluminum and the metal forming layers 82 is lithium, even a relatively short weapon mission time would cause complete melting of the lithium layers 82 due to the relatively low melting temperature of lithium, 179 degrees Celsius. However, if the weapon mission time is relatively long, melting and superheating of both the lithium and aluminum would occur. At termination of the weapon's mission, weapon control module 100 generates an electrical signal on electrical link 92 that detonates explosive charge 90. The explosion of explosive charge 90 explodes metal structure 60 and ruptures seams 50, 52, 54 and 56 of outer shell 44 thereby causing a rapid introduction of the liquid or molten metal into the liquid medium (e.g. ocean). The interaction of the liquid or molten metal with the liquid medium produces several vapor explosions and chemical reactions that produce shock waves, vapor bubbles, and molten metal shrapnel. These vapor explosions are in addition to the main explosion caused by the warhead carried by the weapon.

Although a particular embodiment of the invention has been described, it is to be understood that modifications and other embodiments are possible. For example, the details of metal structure 60 can be varied. Instead of having layers 82, body portion 80 can be made from a single metal. The metals used in metal structure 60 can be varied depending upon the thermal properties of rocket 64 and the expected time for completion of the weapons' mission. Non-reactive metals such as steel alloys can be used to maximize effectiveness of the weapon when impact with a relatively large surface target is required. Apparatus 42 can be used with or without a conventional warhead. Thus, apparatus 42 can be operated without a conventional warhead, thereby relying only on the impact of the weapon on the target and the vapor explosion so as to control or minimize the amount of damage done to a target. Metal structure 60 can be configured to be used with a conventional non-rocket powered weapon. Apparatus 42 can be configured to have a protective sub-compartment that envelopes metal structure 60 to prevent contact of the liquid or molten metal with heat shield 70.

Thus, apparatus 42 of the present invention provides many advantages. Specifically, apparatus 42 significantly enhances the lethality of the weapon with which it used. The vapor explosion created by apparatus 42 at mission termination significantly enhances the effectiveness of the weapon against large surface targets (e.g. ships or other vessels) as well as multi-hulled vessels. Explosive charge 90 does not require any special arming device or arming procedure and simply relies on an electrical signal from weapon control module for detonation.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations in changes may be made by those skilled in the art without departing from the spirit of the invention. Accordingly, the foregoing detailed description should be considered exemplary in nature and not limited to the scope and spirit of the invention as set forth in the attached claims.

What is claimed is:

1. A weapon propulsion system, comprising:

an outer shell defining a chamber having a nozzle port, the outer shell having a plurality of seams that are configured to rupture upon an explosion occurring within the chamber;

a body portion disposed within the outer shell and being composed of a first metal having a first predetermined melting temperature, the body portion having a propulsion device space formed therein, the propulsion device space having an opening that is substantially aligned with the nozzle port;

an explosive device embedded in the body portion;

an electrical link joined to the explosive device and capable of transmitting an electrical signal that detonates the explosive device, the electrical link extending from the body portion; and a propulsion device positioned within the propulsion device space of the body portion and having a nozzle extending through the opening and nozzle port, the propulsion device generating an amount of heat during operation thereof sufficient to melt at least a portion of the body portion.

2. The weapon propulsion system according to claim 1 further comprising a heat shield between the body portion and the outer shell to contain the heat generated by the propulsion device to facilitate melting at least a portion of the body portion.

3. The weapon propulsion system according to claim 1 further comprising a heat shield between the explosive charge and the body portion to thermally isolate the explosive charge.

4. The weapon propulsion system according to claim 1 further comprising at least one layer composed of a second metal embedded within the body portion, the second metal having a second predetermined melting temperature that is less than the first predetermined melting temperature.

5. The weapon propulsion system according to claim 4 wherein the at least one layer comprise multiple layers and the multiple layers are spaced apart and generally parallel to each other.

6. The weapon propulsion system according to claim 4 wherein the second metal is chosen from the group comprising lithium, magnesium, sodium, potassium and lead.

7. The weapon propulsion system according to claim 1 wherein the first metal is aluminum.

* * * * *